US009772112B2

(12) United States Patent
Raggi et al.

(10) Patent No.: US 9,772,112 B2
(45) Date of Patent: Sep. 26, 2017

(54) GLASS DOOR

(71) Applicant: Electrolux Home Products, Inc., Charlotte, NC (US)

(72) Inventors: Tommaso Raggi, Nashville, TN (US); Robert Craig Bontrager, Nashville, TN (US); Ronald Gene Brant, Greenbrier, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 428 days.

(21) Appl. No.: 14/331,826

(22) Filed: Jul. 15, 2014

(65) Prior Publication Data

US 2015/0020792 A1 Jan. 22, 2015

Related U.S. Application Data

(60) Provisional application No. 61/847,300, filed on Jul. 17, 2013.

(51) Int. Cl.
*F24C 15/00* (2006.01)
*F24C 15/04* (2006.01)

(52) U.S. Cl.
CPC ..... *F24C 15/006* (2013.01); *F24C 15/04* (2013.01)

(58) Field of Classification Search
CPC ..... F24C 15/04; F24C 15/006
See application file for complete search history.

(56) References Cited

U.S. PATENT DOCUMENTS

| | | | | |
|---|---|---|---|---|
| 4,206,338 | A | 6/1980 | Katona | |
| 4,253,286 | A | 3/1981 | Katona | |
| 4,519,377 | A | 5/1985 | Taylor | |
| 5,337,727 | A * | 8/1994 | Borens | F24C 15/04 126/198 |
| 5,387,258 | A | 2/1995 | Puricelli | |
| 6,848,441 | B2 * | 2/2005 | Bachinski | F23M 7/04 126/198 |
| 6,959,705 | B2 * | 11/2005 | Briedis | F24C 15/04 126/190 |
| 7,228,857 | B2 | 6/2007 | Kim et al. | |
| 7,708,007 | B2 * | 5/2010 | Kim | F24C 15/04 110/175 R |
| 7,874,289 | B2 | 1/2011 | Larsen | |
| 8,173,942 | B2 | 5/2012 | Wiseman et al. | |
| 8,490,616 | B2 | 7/2013 | Venenzia et al. | |
| 2009/0194090 | A1 | 8/2009 | Kim et al. | |
| 2010/0145483 | A1 | 6/2010 | McGonagle et al. | |

* cited by examiner

*Primary Examiner* — Alfred Basichas
(74) *Attorney, Agent, or Firm* — Pearne & Gordon, LLP

(57) ABSTRACT

Provided is a cooking appliance that includes an oven cavity, at least one heating element for heating the oven cavity, and a door movable between an open position and a closed position for selectively providing access to the oven cavity. The door includes a first glass pane spaced from a second glass pane to define a space therebetween. The cooking appliance further includes a blower configured to move air through the space between the first glass pane and the second glass pane. The door includes a longitudinal axis that is substantially vertical when the door is in the closed position and the first glass pane and the second glass pane each form an acute angle with the longitudinal axis.

19 Claims, 5 Drawing Sheets

GLASS DOOR

CROSS-REFERENCE TO RELATED APPLICATIONS

This application claims the benefit of U.S. Provisional Patent Application No. 61/847,300 filed on Jul. 17, 2013, the entire disclosure of which is hereby incorporated herein by reference

TECHNICAL FIELD

This application relates generally to a cooking appliance and, more specifically, to a cooking appliance comprising an all glass door.

BACKGROUND

A cooking appliance can include an oven cavity having an opening which is selectively closed by a door. One important consideration in connection with an oven door is the need to assure that a front or outer surface of the door is maintained at an acceptable temperature throughout a cooking operation as the front surface can be touched by a consumer. In an oven door which lacks a window or transparent zone for visually inspecting the contents of the oven cavity, a significant amount of room exists for insulation material. However, when the door is designed to be fully or partially transparent, the available space for insulation is significantly reduced. Regardless, excessive heating of the front surface of the door must still be considered.

SUMMARY

Therefore, there is a need for a cooking appliance having an oven door that is fully or partially transparent with a front or outer surface that can be maintained at an acceptable temperature throughout a cooking operation.

According to one aspect, the present technology is directed toward a cooking appliance comprising an oven cavity, at least one heating element for heating the oven cavity, and a door movable between an open position and a closed position for selectively providing access to the oven cavity. The door comprises a first glass pane spaced from a second glass pane to define a space therebetween. The cooking appliance further comprises a blower configured to move air through the space between the first glass pane and the second glass pane. The door comprises a longitudinal axis that is substantially vertical when the door is in the closed position and the first glass pane and the second glass pane each form an acute angle with the longitudinal axis.

According to another aspect, the present technology is directed toward a cooking appliance comprising an oven cavity, at least one heating element for heating the oven cavity, and a door movable between an open position and a closed position for selectively providing access to the oven cavity. The door comprises a first glass pane, a second glass pane, and a space defined between the first glass pane and the second glass pane for air to pass through. The space comprises an upper end portion and a lower end portion. The door further comprises a regulating element configured to regulate air passing through the space. The regulating element is positioned within the upper end portion and the lower end portion is substantially unobstructed.

According to another aspect, the present technology is directed toward a cooking appliance comprising an oven cavity, at least one heating element for heating the oven cavity, and a door movable between an open position and a closed position for selectively providing access to the oven cavity. The door comprises a first glass pane, a second glass forming an acute angle with the first glass pane, and a space defined between the first glass pane and the second glass pane for air to pass through. The space comprises an upper end portion and a lower end portion. The door further comprises a regulating element configured to regulate air passing through the space. The regulating element is positioned within the space adjacent the upper end portion.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF THE DRAWINGS

These and other aspects are better understood when the following detailed description is read with reference to the accompanying drawings, in which.

DETAILED DESCRIPTION

Figure 1:
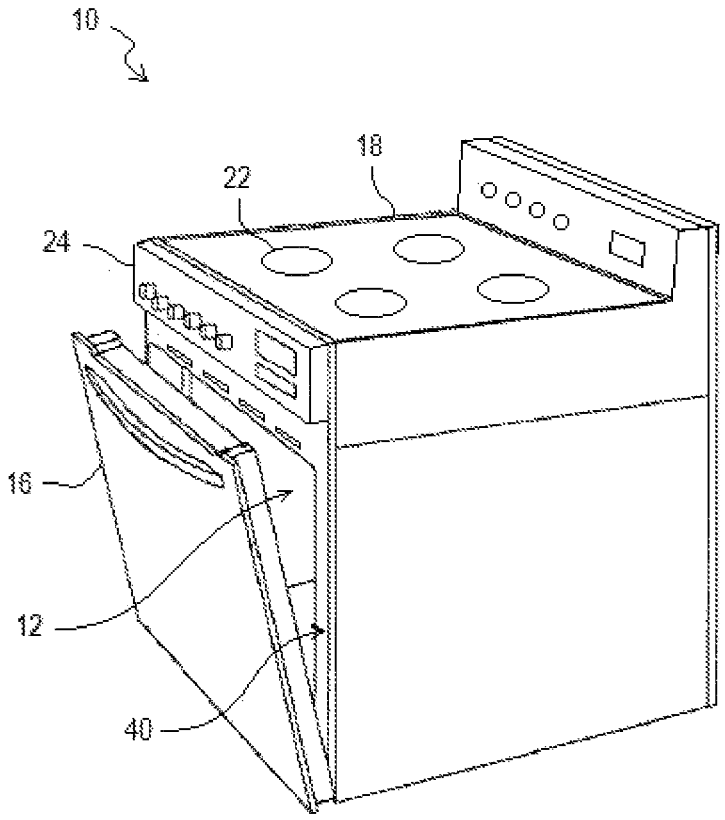
FIG. 1 is perspective view of an example cooking appliance.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Referring now to FIG. 1, an example cooking appliance 10 is shown that comprises an oven cavity 12, at least one heating element for heating the oven cavity 12, and a door 16 movable between an open position and a closed position for selectively providing access to the oven cavity 12. The cooking appliance 10 may comprise a cooktop 18 having one or more burners 22 and a control panel 24 for controlling the heating element of the oven cavity 12 and the one or more burners 22. The cooking appliance 10 may be described as an oven, a range, a stove, a cooker, a home or kitchen appliance, or the like.

Turning to FIGS. 2-5, the door 16 will now be described in further detail. The door 16 may comprise a plurality of glass panes. For example, the door 16 may comprise a first glass pane 28, a second glass pane 30, an outer glass pane 32, and an inner glass pane 34. The plurality of glass panes may be mounted to a frame 36 of the door 16 such that the first glass pane 28 and the second glass pane 30 are provided in between the outer glass pane 32 and the inner glass pane 34. The frame 36 can include one or more hinges 38 that allow the door 16 to be attached to a front surface 40 of the cooking appliance 10 such that the door 16 can pivot between the open position and the closed position. The door 16 can comprise a longitudinal axis X that is substantially vertical when the door 16 is in the closed position.

The outer glass pane 32 may extend substantially across an entire length and width of the door 16 (as shown in FIG. 1), thus giving the door 16 an aesthetically pleasing look. It is to be appreciated that the phrase "substantially across an entire length and width of the door 16" is not intended to mean that the outer pane 32 extends completely across the length and width of the door 16. Rather, the length and/or width of the door 16 may be slightly greater than the length and width of the outer glass pane 32, particularly if mounting structure for the outer glass pane 32 is provided along the perimeter of the outer glass pane 32. The phrase "substantially across an entire length and width of the door 16" is intended to mean that the outer pane 32 can extend a across a substantial majority of the overall length and width of the door 16. For example, the outer pane 32 can extend across 95% or more of the overall length and width of the door 16.

The plurality of glass panes can be transparent to allow for visual inspection of the contents of the oven cavity 12. Moreover, because the outer glass pane 32 extends substantially across the entire length and width of the door 16, a greater area of the oven cavity 12 may be observed through the door 16 as opposed to other embodiments wherein the outer glass pane 32 extends across smaller portions of the length and width of the door 16. However, the scope of the invention is not to be limited to embodiments wherein the outer glass pane 32 extends substantially across the entire length and width of the door 16 and indeed can include embodiments wherein the outer glass pane 32 extends across smaller portions of the length and width of the door 16.

Although the door 16 in the present example comprises four glass panes, it is to be appreciated that the door 16 may comprise any number of glass panes. For example, the door 16 may comprise simply the outer glass pane 32 and the inner glass pane 34 without the first glass pane 28 and the second glass pane 30. Alternatively, the door 16 may comprise five or more glass panes. The plurality of glass panes may comprise any number of glass panes that is two or more.

Figure 3:
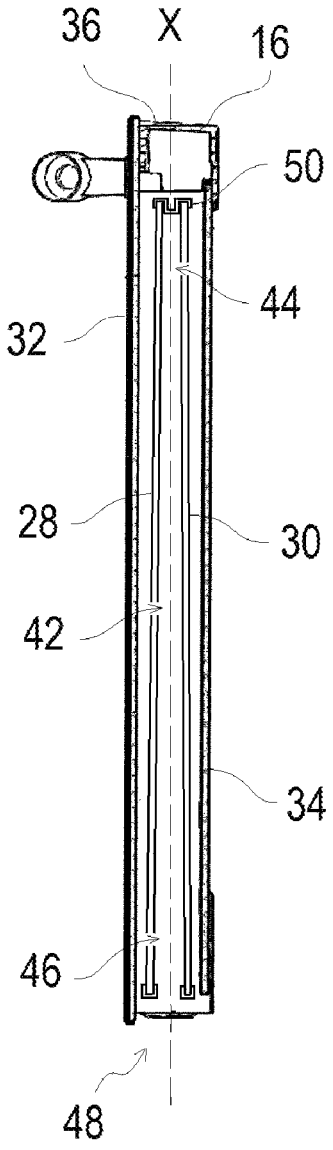
FIG. 3 is a cross-sectional view of the door assembled according to a first configuration.

As can be seen in FIG. 3, the plurality of glass panes are spaced apart from each other to define spaces therebetween. For example, the first glass pane 28 and the second glass pane 30 can be arranged to define a space 42. The space 42 can include an upper end portion 44 and a lower end portion 46. The cooking appliance 10 can comprise a blower (not shown) configured to move air through the space 42 between the first glass pane 28 and the second glass pane 30. For example, the blower can draw air into an inlet 48 in the bottom of the door 16, move the air through the space 42 in a direction from the lower end portion 46 to the upper end portion 44, and then expel the air out of the cooking appliance 10. However, the blower can draw air into and expel the air out of other inlets and outlets. Moreover, the blower can be configured to move the air through the space 42 in an opposite direction from the upper end portion 44 to the lower end portion 46. Furthermore, the blower can be positioned upstream of the space 42 so that the blower pushes air through the space 42 or the blower may be positioned downstream of the space 42 so that the blower draws air through the space 42. The blower can move air in a variety of ways through the space 42 or any of the other spaces between the plurality of glass panes.

Figure 2:
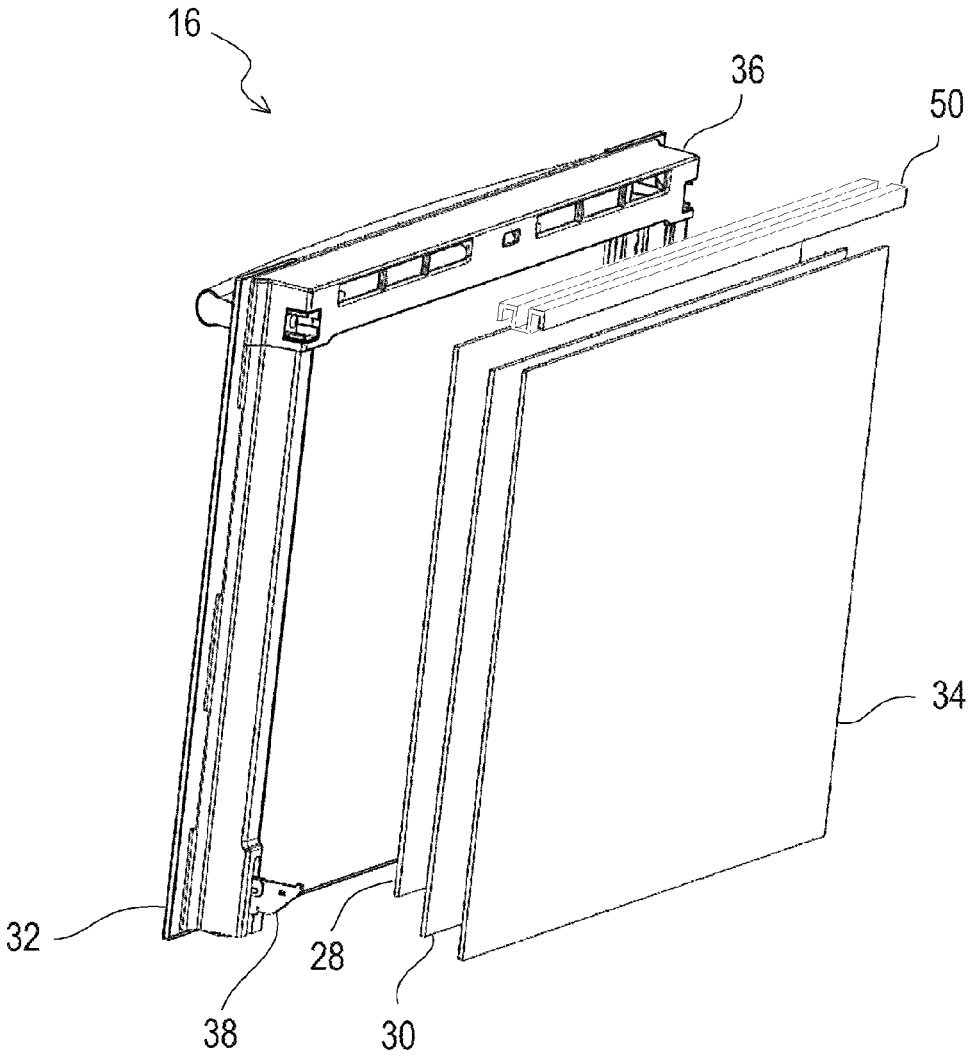
FIG. 2 is an exploded view of a door for the example cooking appliance.
Figure 4:
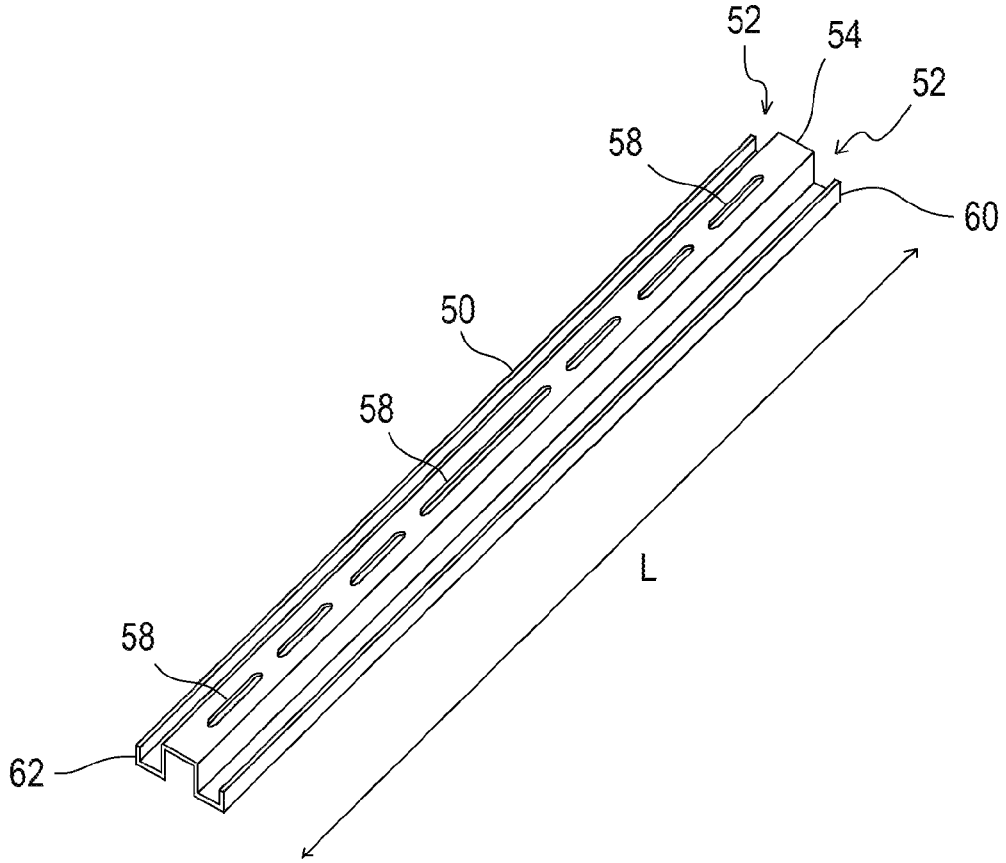
FIG. 4 is a perspective view of a regulating element for the door.

The door 16 can further comprise a regulating element 50 configured to regulate air passing through the space 42. As can be seen in FIGS. 2-4, the regulating element 50 can be an elongated structure comprising a pair of channels 52 for the first glass pane 28 and the second glass pane 30 to rest in and a projecting portion 54 that can be positioned within the upper end portion 44 of the space 42 in between the first glass pane 28 and the second glass pane 30. When the first glass pane 28 and the second glass pane 30 rest in the pair of channels 52, the regulating element 50 can maintain the spacing between the portions of the first glass pane 28 and the second glass pane 30 resting in the pair of channels 52.

The regulating element 50 can comprise one or more apertures 58 for the air moving between the first glass pane 28 and the second glass pane 30 to pass through. The shape, number, and location of the one or more apertures 58 can be designed to regulate the air passing through the space 42 in a desired manner. For example, the number of apertures 58 can be increased to increase the amount of air that passes through the regulating element 50. Likewise, the number of apertures 58 can be decreased to decrease the amount of air that passes through the regulating element 50. Indeed, there may be no apertures 58 in some embodiments in order to completely block air from passing through the regulating element 50. As another example, more apertures 58 can be located near the center of the regulating element 50 to increase the flow of air traveling through the center of the space 42. Alternatively, more apertures 58 can be located near the ends 60, 62 of the regulating element 50 to increase the flow of air traveling near the edges of the first glass pane 28 and the second glass pane 30. As yet another example, the cross-sectional areas for the apertures 58 can be different from one another to vary the amount of air that passes through each aperture 58. For instance, the center aperture 58 can have a cross-sectional area that is larger than cross-sectional areas of the remaining apertures 58 to increase the flow of air traveling through the center of the space 42.

The length L of the regulating element 50 can also be designed to regulate the air passing through the space 42 in a desired manner. For example, the length of the regulating element 50 can extend entirely or partially across the width of the space 42. If the regulating element 50 extends entirely across the width of the space 42, then air passing through the space 42 will be obstructed by the regulating element 50 across the space's entire width. Alternatively, if the regulating element 50 extends only partially across the width of the space 42, then air passing through the space 42 will be unobstructed by the regulating element 50 along portions of the space's width that the regulating element 50 does not extend across. In such instances, the location of regulating element 50 across the width of the space 42 can be shifted to control the portions of the space's width that are obstructed and unobstructed by the regulating element 50.

As can be seen in FIG. 3, the regulating element 50 is positioned within the upper end portion 44 of the space 42, thus leaving the lower end portion 46 substantially unobstructed. Indeed, the entire portion of the space 42 below the regulating element 50 is substantially unobstructed. By "substantially unobstructed" it is meant that the portions of the space 42 below the regulating element 50 are substantially unoccupied and do not include any additional regulating elements. Some structure could still be present within the portions below the regulating element 50 that do not substantially obstruct the air passing through the space 42. For example, mounting structure for the first glass pane 28 and the second glass pane 30 may extend into the lower end portion 46 or other portions of the space 42 below the regulating element 50. However, none of the structure will obstruct the flow of air within the space 42 in a significant manner.

Although the regulating element 50 in the present embodiment is positioned within the upper end portion 44 of the space 42, thus leaving the portions of the space 42 below the regulating element 50 substantially unobstructed, it is to be appreciated that the regulating element 50 may be positioned within the lower end portion 46 of the space 42, thus leaving the portions of the space 42 above the regulating element 50 substantially unobstructed. Moreover, there may be embodiments wherein regulating elements are positioned within both the upper end portion 44 and lower end portion 46 or embodiments wherein one or more regulating elements are positioned within portions of the space 42 in between the upper end portion 44 and lower end portion 46. Furthermore, the regulating element 50 may be positioned between other glass panes. For example, the regulating element 50 could be positioned between the first glass pane 28 and the outer glass pane 32 to regulate air passing therebetween and to maintain spacing of the first glass pane 28 and the outer glass pane 32. The regulating element 50 may be positioned within a variety of spaces in between the plurality of glass panes to regulate air flow therebetween and to maintain spacing of the glass panes.

The plurality of glass panes may be further angled to modify the spaces therebetween and help regulate the flow of air within. For example, as can be seen in FIG. 3, the first glass pane 28 and the second glass pane 30 can be angled such that each form an acute angle with the longitudinal axis X of the door 16. More specifically, the first glass pane 28 and the second glass pane 30 are angled such that the major surfaces of the glass panes 28, 30 that are facing the space 42 extend along planes that form an acute angle with the longitudinal axis X that open towards the bottom of the door 16. Indeed, the major surfaces of the glass panes 28, 30 that are facing the space 42 extend along planes that form an acute angle with each other as well. In addition, the first glass pane 28 and the second glass pane 30 are angled such that they respectively form an acute angle with the outer glass pane 32 and the inner glass pane 34, which are both aligned parallel with the longitudinal axis X of the door 16. More specifically, the major surfaces of the first glass pane 28 and the outer glass pane 32 that are facing each other extend along planes that form an acute angle opening towards the top of the door 16. Meanwhile, the major surfaces of the second glass pane 30 and the inner glass pane 34 that are facing each other extend along planes that also form an acute angle opening towards the top of the door 16.

Figure 5:
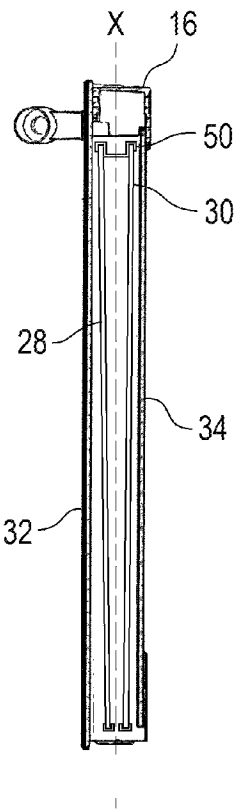
FIG. 5 is a cross-sectional view of the door assembled according to a second configuration.

FIG. 5 shows another example configuration for the plurality of glass panes wherein the first glass pane 28 and the second glass pane 30 each form an acute angle with the longitudinal axis X and the outer glass pane 32 and the inner glass pane 34, are both aligned parallel with the longitudinal axis X. However, in this example, the first glass pane 28 and the second glass pane 30 are angled such that the major surfaces of the glass panes 28, 30 that are facing the space 42 extend along planes that form an acute angle with the longitudinal axis X that open towards the top of the door 16. In addition, the major surfaces of the first glass pane 28 and the outer glass pane 32 that are facing each other extend along planes that form an acute angle opening towards the bottom of the door 16. Meanwhile, the major surfaces of the second glass pane 30 and the inner glass pane 34 that are facing each other extend along planes that also form an acute angle opening towards the bottom of the door 16.

Figure 6:
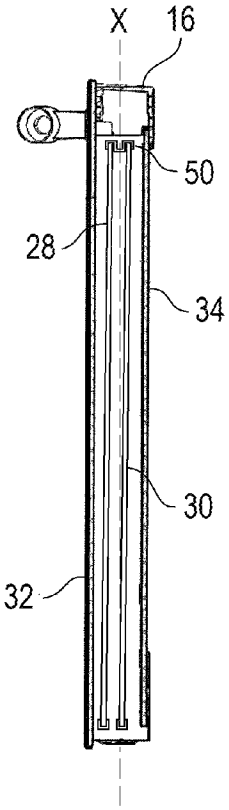
FIG. 6 is a cross-sectional view of the door assembled according to a third configuration.

FIG. 6 shows yet another example configuration for the plurality of glass panes wherein the first glass pane 28 and the second glass pane 30 each form an acute angle with the longitudinal axis X and the outer glass pane 32 and the inner glass pane 34, are both aligned parallel with the longitudinal axis X. In this example, the first glass pane 28 and the second glass pane 30 are parallel with each other. As such, the major surface of the first glass pane 28 facing the space 42 forms an acute angle with the longitudinal axis X opening towards the bottom of the door 16 while the major surface of the second glass pane 30 facing the space 42 forms an acute angle with the longitudinal axis X opening towards the top of the door 16. In addition, the major surfaces of the first glass pane 28 and the outer glass pane 32 that are facing each other extend along planes that form an acute angle opening towards the top of the door 16. Meanwhile, the major surfaces of the second glass pane 30 and the inner glass pane 34 that are facing each other extend along planes that form an acute angle opening towards the bottom of the door 16.

As can be seen in FIGS. 3, 5 and 6, the plurality of glass panes may be arranged to provide a variety of different configurations for the spacing between the plurality of glass panes. For example, the plurality of glass panes may be arranged to provide spaces having an upper end portion that is narrower than a lower end portion, spaces having a lower end portion that is narrower than an upper end portion, and/or spaces that have a constant thickness from their upper end portion to their lower end portion. Some of the plurality of glass panes may be angled relative to the longitudinal axis X while some of the plurality of glass panes may be parallel to the longitudinal axis X. Indeed, there may be embodiments wherein all of the plurality of glass panes are angled relative to the longitudinal axis X. The plurality of glass panes may be angled relative to the longitudinal axis X such that major surfaces of the glass panes form an acute angle with the longitudinal axis that opens towards the bottom of the door 16. Moreover, the plurality of glass panes may be angled relative to the longitudinal axis X such that major surfaces of the glass panes form an acute angle with the longitudinal axis that opens towards the top of the door 16. Indeed, the plurality of glass panes may be angled such that major surfaces of the glass panes form an acute angle with each other that opens towards either the top or the bottom of the door 16. The plurality of glass panes may be angled to provide a variety of different configurations for the spacing between the plurality of glass panes.

By providing one or more of the regulating element 50 described above between the plurality of glass panes and/or angling the plurality of glass panes relative to the longitudinal axis X of the door 16 as discussed above, the air passing through the spaces defined by the plurality of glass panes can be regulated. For example, the regulating element 50 may be positioned within one of the spaces to obstruct the air passing therethrough in a desired manner. The location or length L of the regulating element 50 or the shape, number, or location of the one or more apertures 58 can be adjusted to regulate the airflow through the spaces in a desired manner. In addition, the regulating element 50 can be designed to maintain a desired spacing between the glass panes, which can also affect the airflow passing in between. As the spacing between the glass panes increases or decreases, the quantity and velocity of air passing through the glass panes will change. Moreover, the quantity and velocity of air passing through the glass panes can also be adjusted by changing the angle of the plurality of glass panes relative to the longitudinal axis X of the door 16. For example, angling glass panes such that one end portion of a space between the glass panes is narrower than another end portion of the space can produce a chimney effect that helps direct air through the space.

The ability to regulate airflow between the glass panes of the cooking appliance 10 can be advantageous in maintaining the outer surface of the door 16 at an acceptable temperature throughout a cooking operation. More specifically, the airflow between the glass panes may be regulated to provide necessary cooling to the outer surface of the door 16. As such, the regulating element 50 can be provided and/or the plurality of glass panes may be aligned within the door 16 according to any of the arrangements discussed above to regulate the airflow passing between two of the glass panes and help maintain an acceptable temperature for the outer surface of the door 16 throughout a cooking operation.

Illustrative embodiments have been described, hereinabove. It will be apparent to those skilled in the art that various modifications and variations can be made without departing from the spirit and scope of the claimed invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A cooking appliance comprising:

an oven cavity;

at least one heating element for heating the oven cavity;

a door movable between an open position and a closed position for selectively providing access to the oven cavity, wherein the door comprises a first glass pane spaced from a second glass pane to define a space therebetween; and a blower configured to move air through the space between the first glass pane and the second glass pane, the door comprises a longitudinal axis that is substantially vertical when the door is in the closed position and the first glass pane and the second glass pane each form an acute angle with the longitudinal axis.

2. The cooking appliance according to claim 1, wherein the door further comprises an outer glass pane, further wherein the first glass pane and the second glass pane each form an acute angle with the outer glass pane.

3. The cooking appliance according to claim 2, wherein the outer glass pane extends substantially across an entire length and width of door.

4. The cooking appliance according to claim 2, wherein the door further comprises an inner glass pane, further wherein the first glass pane and the second glass pane are provided between the inner glass pane and the outer glass pane and each form an acute angle with the inner glass pane.

5. The cooking appliance according to claim 4, wherein the outer glass pane and the inner glass pane are substantially parallel with each other.

6. The cooking appliance according to claim 4, wherein the outer glass pane and the inner glass pane are substantially parallel with the longitudinal axis.

7. The cooking appliance according to claim 1, wherein the first glass pane and the second glass pane are substantially parallel with each other.

8. The cooking appliance according to claim 7, wherein the space comprises an upper end portion and a lower end portion and the regulating element is positioned within the upper end portion.

9. The cooking appliance according to claim 7, wherein the regulating element maintains a spacing between the first glass and the second glass.

10. The cooking appliance according to claim 1, further comprising a regulating element configured to regulate the air passing through the space, wherein the regulating element is positioned within the space.

11. A cooking appliance comprising:

an oven cavity;

at least one heating element for heating the oven cavity; and a door movable between an open position and a closed position for selectively providing access to the oven cavity, wherein the door comprises:

a first glass pane, a second glass pane, a space defined between the first glass pane and the second glass pane for air to pass through, wherein the space comprises an upper end portion and a lower end portion, a regulating element configured to regulate air passing through the space, wherein the regulating element is positioned within the upper end portion, wherein the lower end portion is substantially unobstructed, and wherein the door comprises a longitudinal axis that is substantially vertical when the door is in the closed position and the first glass pane and the second glass pane each form an acute angle with the longitudinal axis.

12. The cooking appliance according to claim 11, wherein the space is substantially unobstructed between the lower end portion and the regulating element.

13. The cooking appliance according to claim 11, wherein the regulating element comprises one or more apertures for the air to pass through.

14. The cooking appliance according to claim 11, wherein the regulating element comprises a first aperture having a first cross-sectional area and a second aperture having a second cross-sectional area that is different than the first cross-sectional area.

15. The cooking appliance according to claim 11, wherein the regulating element maintains a spacing between the first glass and the second glass.

16. The cooking appliance according to claim 11, wherein the regulating element extends across an entire width of the first glass pane.

17. The cooking appliance according to claim 11, wherein the regulating element extends partially across a width of the first glass pane.

18. The cooking appliance according to claim 11, wherein the door further comprises an outer glass pane and an inner glass pane, further wherein the first glass pane and the second glass pane each form an acute angle with the outer glass pane and the inner glass pane.

19. The cooking appliance according to claim 11, wherein the second glass pane forms an acute angle with the first glass pane.

* * * * *